US006633268B2

(12) United States Patent
Kougami et al.

(10) Patent No.: US 6,633,268 B2
(45) Date of Patent: Oct. 14, 2003

(54) AC-TYPE PLASMA DISPLAY APPARATUS

(75) Inventors: Akihiko Kougami, Kokubunji (JP); Keizo Suzuki, Kodairai (JP); Hiroshi Kajiyama, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 205 days.

(21) Appl. No.: 09/811,604

(22) Filed: Mar. 20, 2001

(65) Prior Publication Data

US 2002/0109650 A1 Aug. 15, 2002

(30) Foreign Application Priority Data

Feb. 13, 2001 (JP) ..... 2001-034957

(51) Int. Cl.[7] ..... G09G 3/28
(52) U.S. Cl. ..... 345/60; 345/208; 345/210
(58) Field of Search ..... 345/37, 41, 42, 345/60, 62–63, 66–68, 208, 210

(56) References Cited

U.S. PATENT DOCUMENTS 5,790,087 A * 8/1998 Shigeta et al. ..... 345/67
6,369,781 B2 * 4/2002 Hashimoto et al. ..... 345/60
6,483,487 B2 * 11/2002 Iseki ..... 345/60

FOREIGN PATENT DOCUMENTS

| | | |
|---|---|---|
| JP | 6-149176 | 5/1994 |
| JP | 9-6280 | 1/1997 |
| JP | 11-265163 | 9/1999 |

* cited by examiner

*Primary Examiner*—Kent Chang
*Assistant Examiner*—Tom Sheng
(74) *Attorney, Agent, or Firm*—Antonelli, Terry, Stout & Kraus, LLP

(57) ABSTRACT

The present invention relates to an AC-type plasma display apparatus, an object of the invention is to provide the AC-type plasma display apparatus improved a quality of a picture of a display image by realizing a multi-sub-field arrangement and a high gray scale arrangement, after by being realized an address discharge at high speed.

As illustrated in FIG. 1, an address discharge is constituted so as to be driven at high speed by applying preset pulses 105 of a narrow width prior to time of application of a scanning pulse 106 exceeding a value of a discharge breakdown voltage, and by carrying out growth (growing process of Townsent) of a space charge by the preset pulses 105.

25 Claims, 15 Drawing Sheets

AC-TYPE PLASMA DISPLAY APPARATUS

BACKGROUND OF THE INVENTION

Field of the Invention

The present invention relates to AC-type plasma display apparatuses, and more particularly to an AC-type plasma display apparatus suitable for a display device carrying out an address discharge drive at high speed.

In the AC-type plasma display apparatus, a TV device to replace a conventional CRT as a display device having a large screen, being a thin flat type, and in light weight, has already been commercially produced.

Up to the present time, a Video Graphic Array TV having the number of lines of 480 pieces and belonging to a class of 40 inches in duration and a HDTV (abbreviation of High definition Tele-Vision) performing interlace scanning has been realized.

The AC-type plasma display apparatus, though already commercially finished in production, having a considerable number of subjects in terms of its performance, and has not yet excelled CRT in view of a quality of a picture.

As to the performance of a plasma display apparatus, in addition to basic performance required generally as a display apparatus such as display brightness, a contrast, resolution, a gray scale number, and consumption power, a problem in a quality of a picture of a dynamic picture has, in recent years, been encountered.

In a display method of gray scale of a plasma display apparatus, since time duration modulation by a light emit time duration is utilized with respect to amplitude modulation of brightness such as a CRT, an intrinsic deterioration in a quality of a picture relative to a dynamic picture is generated. In order to improve the performance of these plasma display apparatus, it is necessary to drive a plasma display panel at high speed and to enlarge values of various parameters determining a quality of a picture.

In an AC-type plasma display panel of this sort, as everybody knows, three electrodes of display electrodes composed of a paired X electrode-Y electrode in parallel to each other and of an address electrode (A electrode) intersecting these display electrodes are formed, and a surface discharge type panel is constituted. Further, cells are being pixels are constituted at points of intersection of these display electrodes and the address electrodes arranged in rows in a shape of stripes, a considerable number of cells form a two dimensional matrix inside the panel. In a matrix panel such as a plasma display, common electrodes are formed in the cells in every respective lines.

In a display method of gray scale of the plasma display apparatus, a sub-field method is used. A gray scale is expressed by a light emitting time duration of total of one field by dividing time of one field into a plurality of sub-fields, by varying a light emitting time duration in respective sub-fields, and by combining the light emitting time duration of several sub-fields while controlling a light emission of respective sub-field.

For example, when one field is divided into eight sub-fields and ratios of light emitting time durations of respective sub-fields are constituted in such a manner as 1:2:4:8:16:32:64:128, the gray scale of 256 steps from starting 0 ending at 255 can be displayed by controlling whether these sub-fields are emitted light or not and combining the light emitting time duration of respective sub-fields.

The number of gray scales of a plasma display apparatus is determined by the number of the sub-fields. When fine scaling a display of brightness by increasing the number of sub-fields, a quality of a picture having smooth display can be displayed even for a picture image gradually changing the brightness.

In the plasma display apparatus at present, the number of gray scales of brightness is in a degree of 100 gray scales, it occurred such a phenomenon as that delicate changing of brightness smashed into black color when a dark picture image is displayed. In order to display a further fine gray scale even for a dark picture image, the number of 1024 gray scales is necessitated, even constituting it of 2 to the n-th power having the least number of the sub-fields, n is 10, that is, 10 sub-fields are necessitated.

Further, in a sub-field method like this, it is well known that a dynamic false contour noise which deteriorates the quality of picture in the dynamic picture, is generated. In order to reduce this, a method to make inconspicuous the dynamic false contour noise is employed by setting a code of weight of a sub-field as a code different from 2 to the number of power, by being held a redundant property to the code, and by changing a combination of the light emission in a sub-field of display lines or the cells.

For that purpose, the number of sub-fields much more numerous is required and the number of the sub-fields in a degree of 15 is ideal. Since one field of a TV signal is approximately 16.7 ms, it means that an increase in the number of sub-fields is a decrease in time assigned to one sub-field.

A driving method separated into three, such as a reset period, an address period, and a display sustain period is generally used for one sub-field. These periods are common periods in an entire lines of the display panel, this driving method is referred to as an ADS (address display separate method). One example of this driving waveform is shown in FIG. 4 and FIG. 5 and necessity of acceleration of a drive will be explained.

In FIG. 4, the entire X electrodes are commonly connected to one another, in the Y electrode, an IC circuit for the purpose of applying a scanning pulse to individual electrodes during an address period is connected to the Y electrode, sustain pulses in a display sustain period are simultaneously applied to entire Y electrodes.

During a reset period of a sub-field, a high voltage pulse (rectangular reset pulse) 100 equal to or more than 300 V is applied to the X electrodes as a reset voltage VR. Thereby, a strong discharge is generated during this period in the entire cells and electrons and ions, constituted as wall charges to respectively in the X electrodes and the Y electrodes, forming an electric field by wall charges themselves accumulated on the X electrode and the Y electrode.

When waveform of the rectangular reset pulse 100 are fallen down, a discharge (self erase discharge/reset discharge) is generated by this electric field, the wall charges are floated in a space and disappears through neutralization. According to this reset discharge, the wall charges of entire cells are reset. During a neutralizing period, voltages of the X electrode, the Y electrode, and the A electrode (address electrode) are set as altogether a GND level, and this neutralizing period is approximately 100 $\mu$s.

Next, during an address period, scanning pulses 106 of a voltage Vy are sequentially applied to the Y electrodes, address pulses 108 of a voltage Va are applied to the A electrodes. In the cells at which the scanning pulses 106 and the address pulses 108 are overlapped with each other, discharges between the electrodes A–Y are generated, the discharges between the electrodes X–Y are generated by being triggered by the discharges between the electrodes A–Y, the wall charges are formed on the X electrodes and the Y electrodes.

During a next display sustain period, sustain pulses 102 and 104 of a voltage Vs are alternately applied to the X electrodes and Y electrode and only for the cells formed the wall charges during an address period, the discharges are selectively generated, and display light is emitted.

This much is a light emitting mechanism of one sub-field, during the address periods, as illustrated in FIG. 5, the scanning pulses 106 are sequentially applied from a Y1 electrode to a Y 480 electrode (VGA is estimated). Accordingly, the display apparatus in which the number of lines being numerous (for example, in HDTV, equal to or more than 1000 pieces) the scanning pulses 106 equal to the number of lines must be applied.

However, in the address discharge generated by the scanning pulses 106, there is a time delay or there is dispersion depending on the cell, a time duration of a certain degree is necessitated in order to obtain reliability of a display. For example, in a VGA display apparatus, the time duration of the scanning pulses 106 is 2.4 $\mu$s, in a case of HDTV display apparatus, having the number of lines 1000 pieces, the address period reaches 2.4 ms. The address period is necessitated to the entire sub-fields, when there are 8 sub-fields, time of one field portion are filled with only the address periods.

As described above, the address periods are required to be shortened in order to obtain a display of multi-sub-field arrangement (increase in the number of sub-fields) or a display of high precise arrangement (high density arrangement by decrease in size of cell and an increase in the number).

In order to realize these, there is a method to conduct interlace scanning. That is, a display of one field is made in a display of on every other line, the number of lines to be addressed are reduced in a half, and high precise (HDTV) display is tried to be performed. However, in this display, a flickering phenomenon is generated, in particular, a line flicker is remarkable, and a quality of a picture is largely damaged.

Further, the other method of decreasing in the address periods, the address electrodes are separated to the upper section and lower section of the panel, a method to simultaneously drive two lines. However, in this method, since the number of the address electrodes are doubled, the number of an integrated circuit driver is doubled, there is a drawback that the cost of a product is increased.

SUMMARY OF THE INVENTION

As described in the conventional example, a decrease in an address period is required in order to realize a fine scale display of brightness even in a dark picture image by an increase in the gray scale number, to try a reduction in a dynamic false contour noise of a dynamic picture, to realize a high precise panel display apparatus. For that purpose, an address discharge is required to be accelerated.

Accordingly, an object of the present invention is to provide an AC-type plasma display apparatus further improving a quality of a picture of a display picture image by resolving conventional drawbacks, by realizing a high speed address discharge, and by realizing a multi-sub-field arrangement and high gray scale in order to solve the problems described above.

In order to achieve the object described above, in the present invention, in an address discharge drive of an AC-type plasma display apparatus, it is constituted as that equal to or more than one piece of pulses of a narrow width as a preset pulse is/are applied, prior to time applying a scanning pulse, with a voltage exceeding a discharge breakdown voltage determined by a wall charge of a reset discharge.

In terms of constitutional characteristics of an AC-type plasma display apparatus relating to the present invention, the gist of the present invention will be described further in detail by mentioning specifically in following items (1)–(5).

(1) In an AC-type plasma display apparatus characterized by including display electrodes composed of paired first electrodes and second electrodes in parallel with each other, address electrodes intersecting the display electrodes, and drive circuits conducting address discharges between the display electrodes and the address electrodes, wherein the drive circuit conducting the address discharge has a means for applying pulses equal to or more than one piece of a narrow width predetermined as preset pulses prior to time applying a scanning pulse applied to said display electrode, wherein an apply voltage of the preset pulses is set as a voltage value exceeding a discharge breakdown voltage value determined by a wall charge of a reset discharge.

(2) An AC-type plasma display apparatus as set forth in (1) described above is characterized by having a plurality of sub-fields within one field, by including a reset period at least make uniform a wall charge, an address period for writing-in, and a display sustain period for display light emission, in the sub-field described above, and by having a function for applying scanning pulses sequentially to an electrode corresponding to a display line during the address period, wherein in the address period, the drive circuit conducting the address discharge has a means for applying pulses equal to or more than one piece of a narrow width predetermined as preset pulses prior to time applying the scanning pulse, wherein an apply voltage of the preset pulses is a voltage value larger than a discharge breakdown voltage determined by a wall charge formed after the reset period being terminated, and the preset pulses are sequentially scanned keeping a constant time interval with the scanning pulse.

(3) An AC-type plasma display apparatus as set forth in (1) described above is characterized by including a paired plurality of first display electrodes and second display electrodes in parallel with each other and a plurality of address electrodes intersecting said display electrodes, wherein at least the display electrode has a panel covered by dielectric layer, time of one field is divided into a plurality of sub-fields, and the sub-field has at least a reset period, an address period, and a display sustain period, wherein in case of conducting write-in by applying a scanning pulse to the first display electrodes during the address period and by applying an address pulse to the address electrode, the sub-field described above has a means for applying pulses equal to or more than one piece of a narrow width having the same polarity as the scanning pulse predetermined as preset pulses prior to time applying the scanning pulse applied to the first display electrode, wherein an apply voltage of the preset pulses is set as a voltage value exceeding an address discharge breakdown voltage.

(4) An AC-type plasma display apparatus as set forth in (1) described above is characterized by dividing one field into a plurality of sub-fields, by including at least a reset period, an address period, and a display sustain period, in the sub-field described above, wherein during the reset period, in case of conducting write-in operation by applying an entire reset pulse accompanied by a self erasing discharge to the second display electrodes, by resetting a remained wall charge of a plasma display panel, and by applying a scanning pulse to the first display electrodes during the address period and by applying a scanning pulse to the first display electrode, the sub-field described above has a means for applying preset pulses equal to or more than one piece predetermined prior to applying the scanning pulse applied to the first display electrode, wherein an apply voltage of the preset pulses is set as a voltage value larger than that of the scanning pulse, and a voltage value exceeding a discharge breakdown voltage.

(5) An AC-type plasma display apparatus as set forth in (1) described above is characterized by dividing one field into a plurality of sub-fields and by including in the sub-field with at least a reset period, an address period, and a display sustain period, wherein, during said reset period, the sub-field described above has a means for conducting a lamp wave reset discharge, resetting, and for lessening a terminated voltage value of the lamp wave is smaller than a voltage value of a scanning pulse applying during the address period and a means for applying pulses equal to or more than one pieces of a narrow width of a voltage value approximately similar to the scanning pulse predetermined as a preset pulse prior to time applied the scanning pulse, in case of application of a scanning pulse to the first display electrodes during the address period.

By applying the preset pulse described above, an address discharge of high speed can be realized by conducting an initial portion (growing process of Townsent) of growth of a discharge by this preset pulse, and by lessening a delay of an address discharge caused by the scanning pulse.

Further, a reset discharge is a rectangular discharge accompanied by a self-erase discharge, an address discharge of high speed can be realized by applying a voltage value of the preset reset pulse with the voltage value larger than a voltage value of the scanning pulse. This means that although the scanning pulse itself can not discharge without the address pulse, by enlarging a voltage of the preset pulse more than a voltage of the scanning pulse, and resulting in a voltage value of the preset pulse exceeding a discharge breakdown voltage even without the address pulse.

Further, an address discharge of high speed can be realized by setting a cycle of the preset pulse approximately similar to a cycle of the scanning pulse. Thereby, a signal processing circuit of an integrated circuit driver can be simplified, so that a reduction in circuit cost can be realized.

Further, an address discharge of high speed can be realized by making a duration of the preset pulse to such a degree of thin line duration as a discharge does not generated. Due to no generation of a discharge to the preset pulse, since formation of a wall charge will not occurs, a discharge is prevented from being inhibited at the next address discharge. Since this preset pulse carries out a growing process of Townsent only and carries out growth of a space charge only, an address discharge constitutes a discharge of small delay and with high speed.

Further, an address discharge of high speed can be realized by constituting a reset discharge being a lamp wave reset discharge, and by enlarging a voltage value of the preset pulse more than a terminated voltage of a lamp wave reset. With these constitutions, since a voltage value of the preset pulse exceeds a discharge breakdown voltage, a growing process of Townsent can be conducted by this preset pulse.

Further, an address discharge of high speed can be realized by lessening a terminated voltage of the lamp wave reset less than a voltage of the scanning pulse and substantially equalizing a voltage of the scanning pulse with that of the preset pulse. According to this, since the voltages of both of the scanning pulse and the preset pulse becoming the same potential, a constitution of a high voltage amplifying circuit to generate pulses can be simplified, therefore, a decrease in cost is possible to be realized.

Further, only growth of a space charge can be implemented, without discharging the preset pulse, by setting a pulse duration of the preset pulse being equal to or less than 0.5 $\mu$s.

According to the present invention, there is an effect that an address discharge is capable of being driven at high speed by applying pulses equal to or more than one piece of a narrow width exceeding a discharge breakdown voltage prior to time of applying the scanning pulse, by carrying out growing process of Townsent with the preset pulses, and by increasing the number of space discharges.

Further, there is an effect that a signal processing part of a circuit driver can be simplified and a circuit of low cost is possible to be realized by attempting a cycle of the preset pulse to be substantially similar to a cycle of the scanning pulse.

Furthermore, there is an effect that a high voltage circuit can be simplified and is capable of being realized in low cost by lessening a terminated voltage of a lamp wave reset less than a voltage of the scanning pulse and by making substantially similar a voltages of the scanning pulse to that of the preset pulse.

DETAILED DESCRIPTION OF THE PREFERRED EMBODIMENTS

Hereinafter, the embodiment of the present invention will be explained in detail with reference to FIG. 1–FIG. 3 and FIG. 6–FIG. 15.

Figure 2:
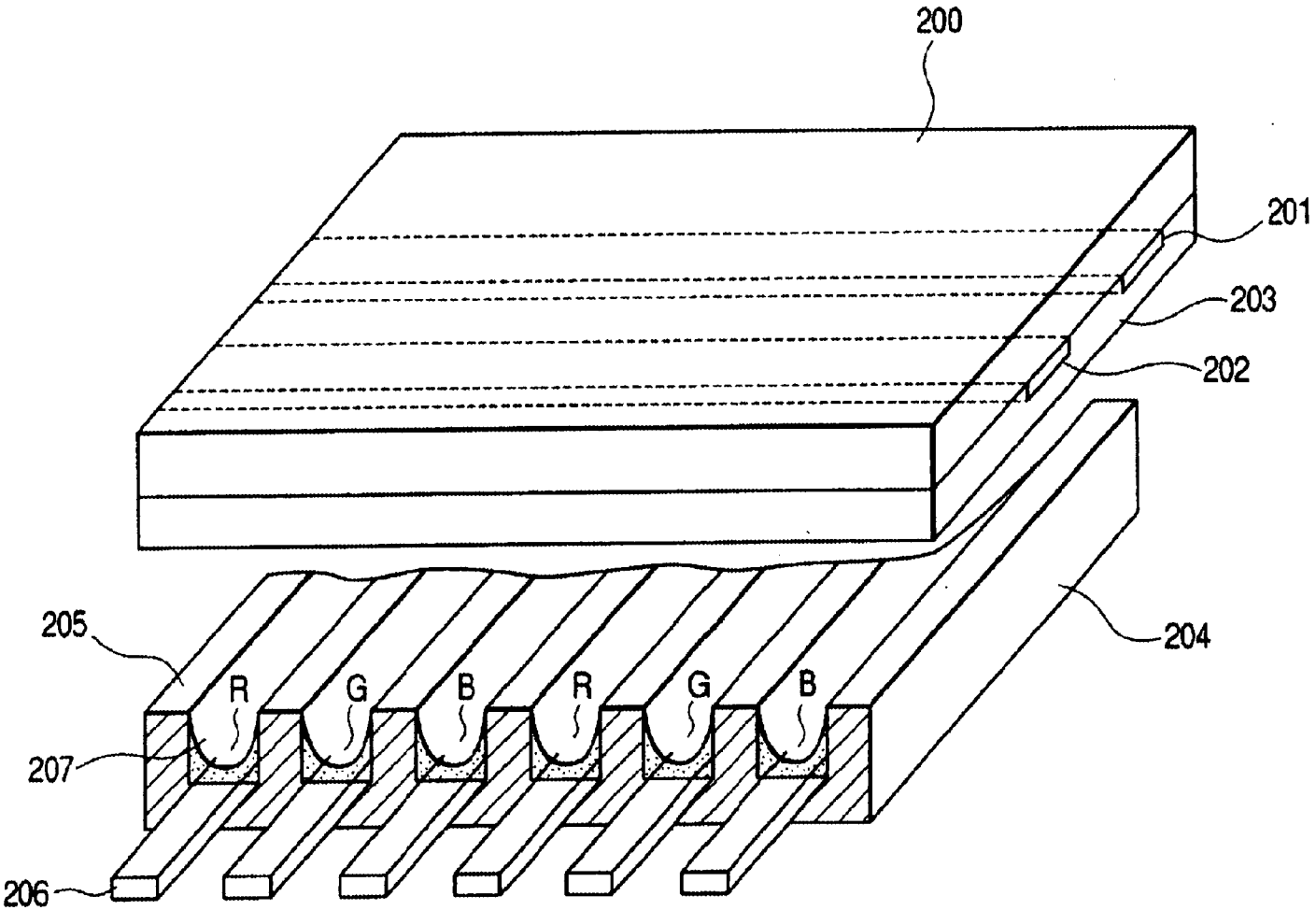
FIG. 2 shows an exploded perspective view of a panel of a plasma display apparatus of the present invention.
Figure 3:
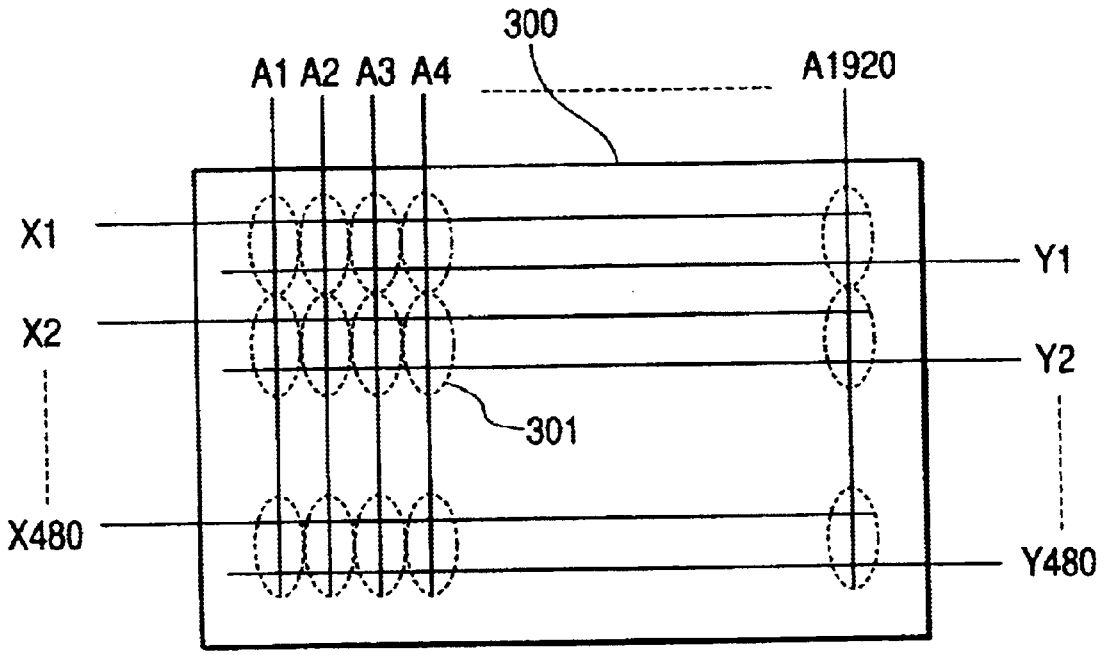
FIG. 3 shows a view illustrating an electrode wiring of a plasma display apparatus.
Figure 4:
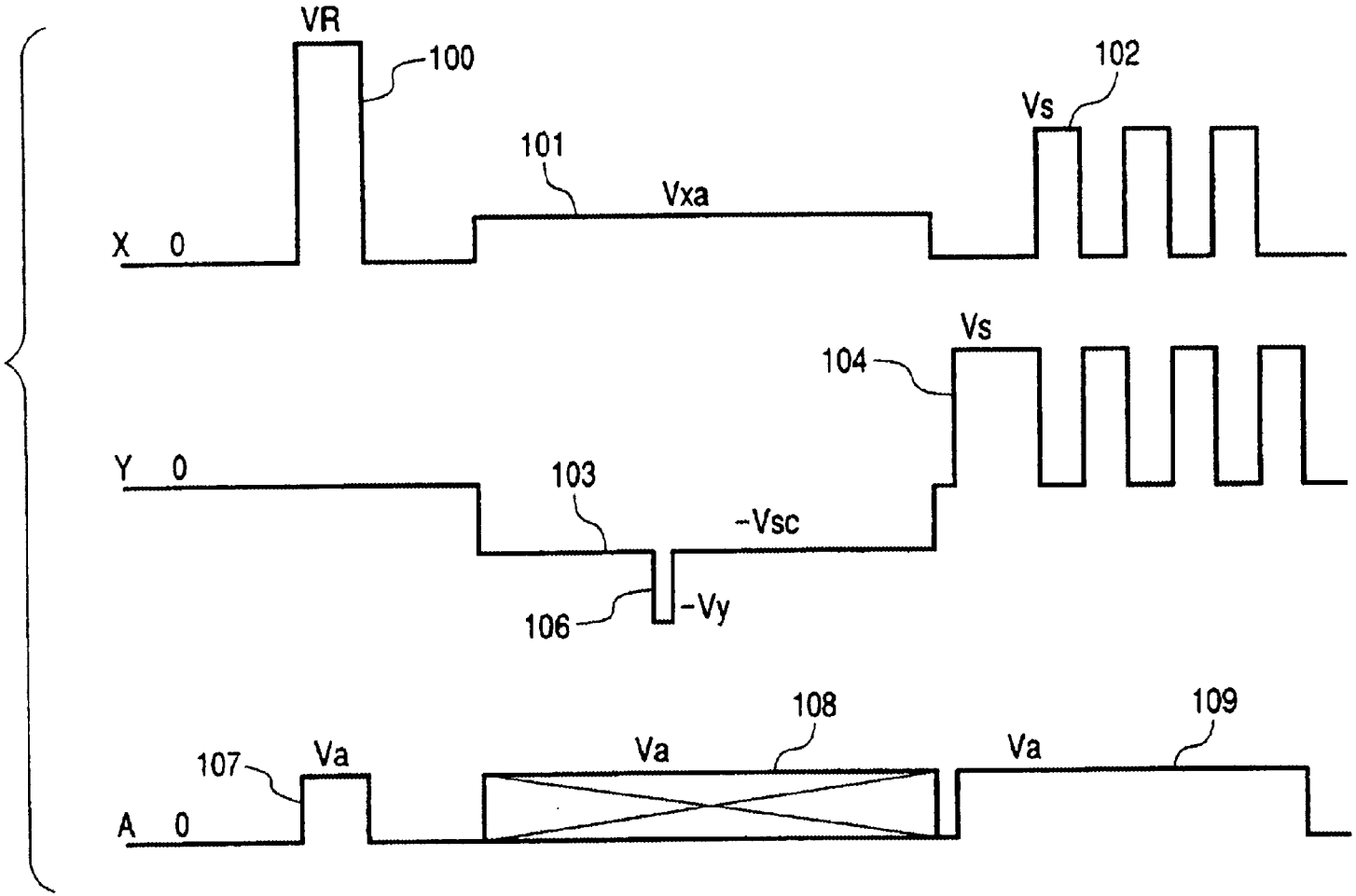
FIG. 4 (PRIOR ART)
FIG. 4 shows a view illustrating a driving waveform of a conventional plasma display apparatus.
Figure 5:
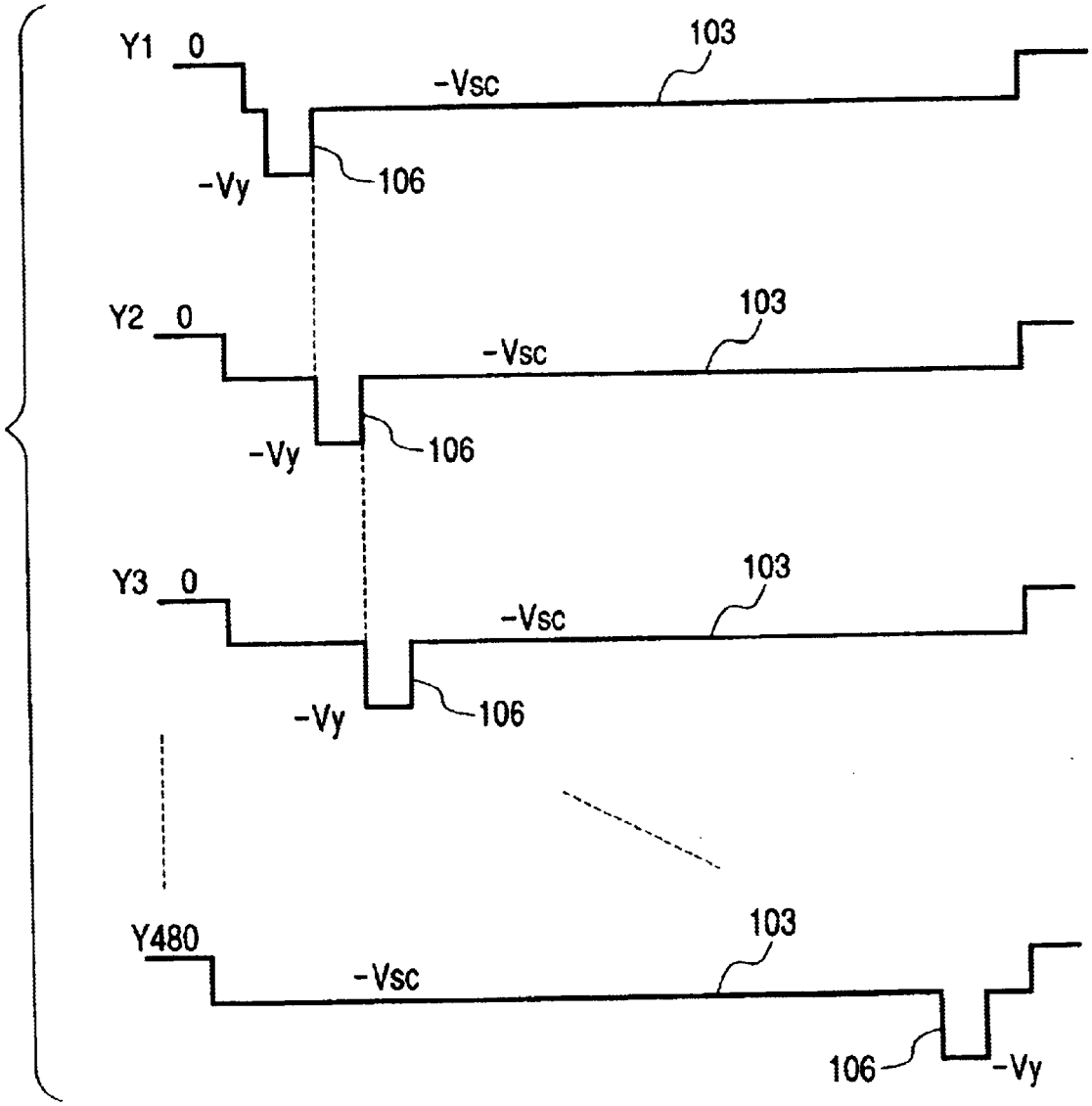
FIG. 5 (PRIOR ART)
FIG. 5 shows a view explaining a method of scanning a scanning pulse.

Firstly, a structure and electrode wiring of an AC-type plasma display panel will be explained with reference to FIG. 2 and FIG. 3, FIG. 2 shows an exploded perspective view of the AC-type plasma display panel. This panel is a surface discharge type panel of 3 electrodes. A pair of X electrode 201 and a Y electrode 202 in parallel with each other as a display electrodes are formed on a faceplate 200 by transparent electrodes. On these transparent electrodes, buss electrodes (for example, metal thin films such as Cr/Cu/Cr) having narrow line widths are formed (not illustrated) for the purpose of reducing their resistance values. Dielectric layers 203 are formed on these X electrode and Y electrode, further, a protection film (MgO) is formed (not illustrated) on the dielectric layer.

On the other hand, on a substrate 204, ribs 205 respectively in a shape of a stripe for delimiting respective discharge cell are formed by a sand-blast method or the like, an A electrode 206 being an address electrode is formed inside the groove provided between ribs opposed to each other. Further, phosphors 207 having respective colors of R, G, and B are applied on an interior wall of the groove and on the A electrode between the ribs 205.

As illustrated in FIG. 2, the X electrodes and the Y electrodes on the faceplate 200 and the A electrodes on the substrate 204 are positioned so as to intersect with each other, the faceplate 200 and the substrate 204 are air tightly sealed, with such a constitutions, a cell in a shape of a stripe delimited by ribs opposed to each other is formed, inside of these cells, mixed gas of Ne—Xe (4%) of a degree of 400 Torr is sealed as discharge gas.

A display sustain pulse (sustain pulse Vs) is applied and discharged between the X electrode 201 and the Y electrode 202, ultraviolet rays are generated from Xe of sealed gas, the phosphors of RGB are emitted light and display is carried out.

FIG. 3 shows a view illustrating electrode wiring of a plasma display panel. As a display electrode, 480 pieces (VGA) of the paired and parallel X electrodes and the Y electrodes are arranged in a horizontal direction, and 1920 pieces of the A electrodes are arranged in a direction cross at right angle with these X–Y electrodes. A discharge cell 301 is constituted at points of intersection of an X electrode, a Y electrode, and an A electrode.

A representative driving method regarding the AC-type plasma display apparatus of the present invention equipped with the AC-type plasma display panel constituted described above, and a drive circuit section where displaying information on this panel will be specifically explained in the following embodiments.

First Embodiment

Figure 1:
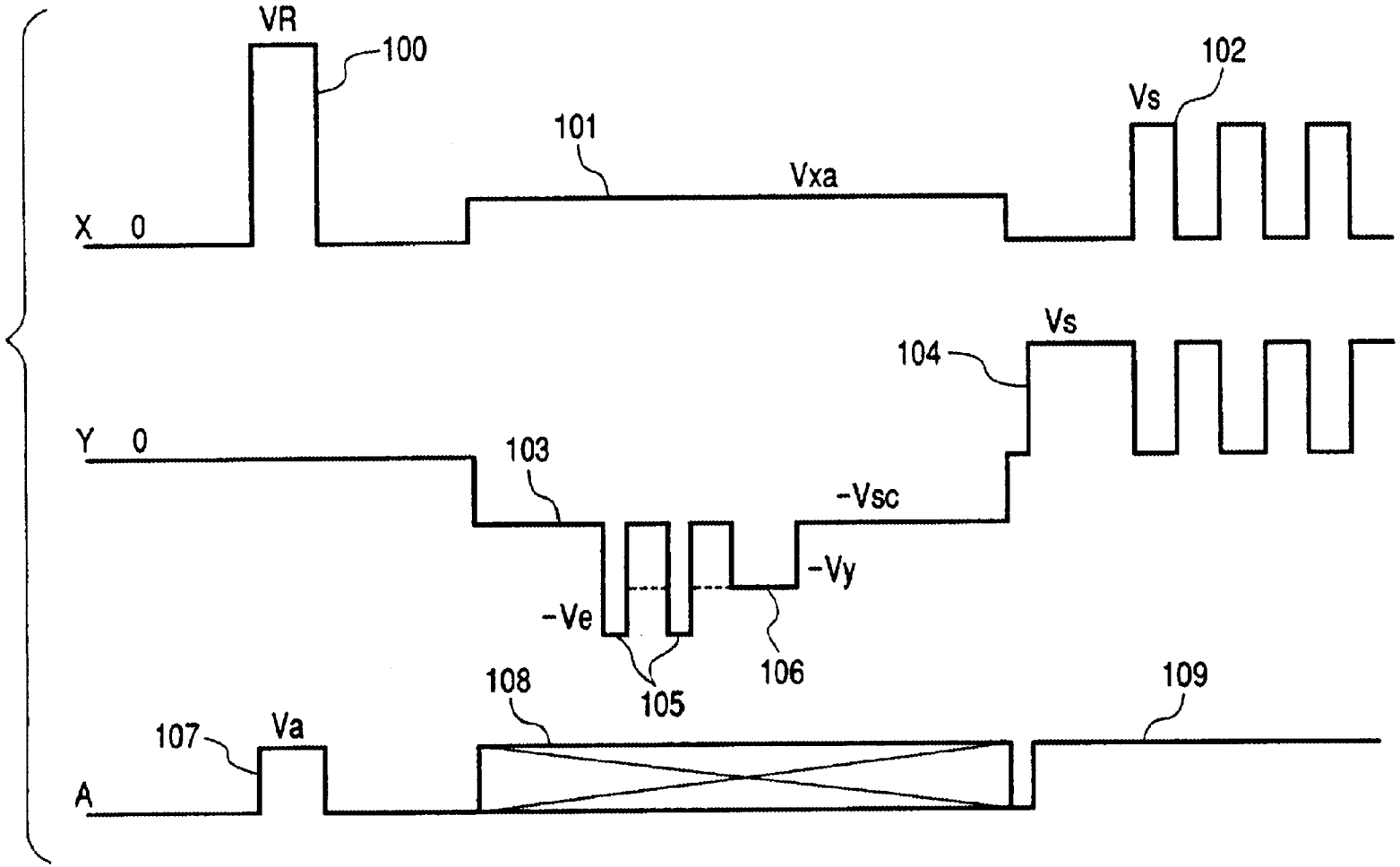
FIG. 1 shows a view illustrating a driving waveform of a plasma display apparatus of the present invention.

FIG. 1 shows a view illustrating a driving waveform for displaying an image in an AC-type plasma display apparatus as the first embodiment of the present invention. Here, it shows a view of a driving waveform of one of a sub-field when a reset is set as a rectangular reset.

In a reset discharge, a wall charge is formed by applying a pulse (rectangular reset pulse 100) of a high voltage VR exceeding 300V to entire X electrodes, and by discharging from the entire discharge cells. At that time, a pulse 107 of a voltage Va is applied to an A electrode in synchronization with the rectangular reset pulse 100 so as not to give rise to a discharge between the A electrode and X electrode.

When the rectangular reset pulse 100 has fallen down, almost entire wall charges are floated in a space within a cell by discharging (self erase discharge) in an electric field of the wall charge itself. The charges floated in the space are disappeared by neutralizing electrons and ions during time of 100 $\mu$s after application of the rectangular reset pulse. Thereby, the entire cells constitutes a uniform state where no wall charges are existed, the entire cells are unitarized.

During a next address period, prior to a scanning pulse 106 on a Y electrode, preset pulses 105 are applied. A voltage of the preset pulse 105 is −Ve, and is constituted larger than a voltage (−Vy) of the scanning pulse 106. A bias pulse of a voltage Vxa is applied to the X electrode, a voltage (Vxa+Ve) between the electrodes X–Y is a larger voltage than a discharge breakdown voltage determined by the wall charge (ideally equal to 0) formed by rectangular resets.

Accordingly, when a pulse duration of the preset pulse 105 is large, a discharge occurs between the electrodes X–Y, however, since the pulse width of the preset pulse 105 is narrow width pulse (0.3–0.5 $\mu$s) a discharge is not generated. During a period of the preset pulse 105, growth (growing process of Townsent) of a space charge is generated.

In the present embodiment, an example of the number of preset pulse 105 being 2 pieces is described. However, in the present invention, the number of the preset pulse 105 may well be equal to or more than 1 piece, the more the number of the preset pulse 105 more intermittently grows the growth of the space charge. However, when the number of the preset pulse is too numerous, it is not desirable that a discharge is generated in the preset pulse resulting in formation of a wall charge. Accordingly, regarding the number of the preset pulse 105 it is desirable that the last preset pulse of the numerous pulses is in a state on the verge of discharging.

In the scanning pulse 106 after the preset pulse 105, a voltage is −Vy, a discharge is not generated only with that voltage, however, when there is an address pulse 108 of a voltage Va in the A electrode, a discharge is generated between the electrodes A–Y. In this discharge between the electrodes A–Y, since the space charge has grown by the preset pulse 105 in advance, the rising of a discharge becomes abrupt.

Further, a discharge between the electrodes A–Y triggered the generation of a discharge between the electrodes X–Y, and a wall charge is formed. There is a display period after the address period, sustain pulses 102 and 104 of the voltage Vs are applied alternately to the X electrode and Y electrode, only cells where an address discharge is generated during the address period and a wall charge is formed, are discharged by the sustain pulses 102 and 104 and display light emission is carried out. In the meantime, in FIG. 1, both of the preset pulse 105 and the scanning pulse 106 are energized with the same bias voltage −Vsc.

Figure 6:
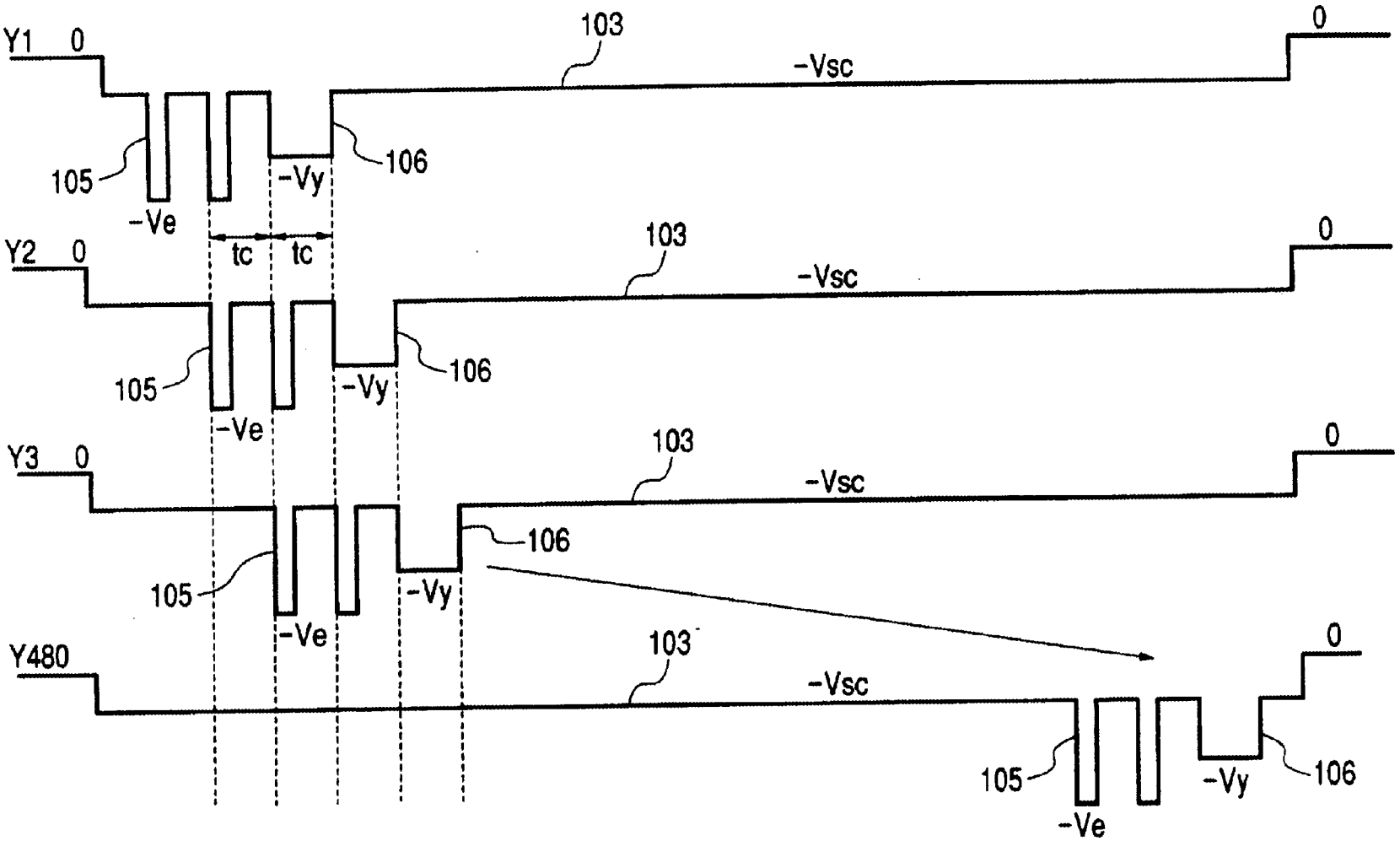
FIG. 6 shows a view explaining a method of scanning a preset pulse of the present invention.

FIG. 6 shows a view illustrating a method of scanning of the preset pulse 105. The scanning pulses 106 are sequentially scanned from Y1 to Y480 and applied to the Y electrodes, the preset pulses 105 are also applied to the Y electrodes prior to the time of scanning by the scanning pulses 106 and also scanned sequentially.

In this case, a cycle tc of the preset pulse is made the same as a cycle tc of the scanning pulse. The preset pulse 105 together with the scanning pulse 106 are energized with the same bias pulse 103 of the voltage −Vsc. Thereby, withstand pressure of an IC can be lessened and reduction in circuit cost can be realized.

Next, an effect (effect for accelerating address discharge) of the preset pulse of the present invention will be explained by using FIG. 7 (comparative example of conventional address discharge) and FIG. 8 (example of address discharge of the present embodiment).

Figure 7:
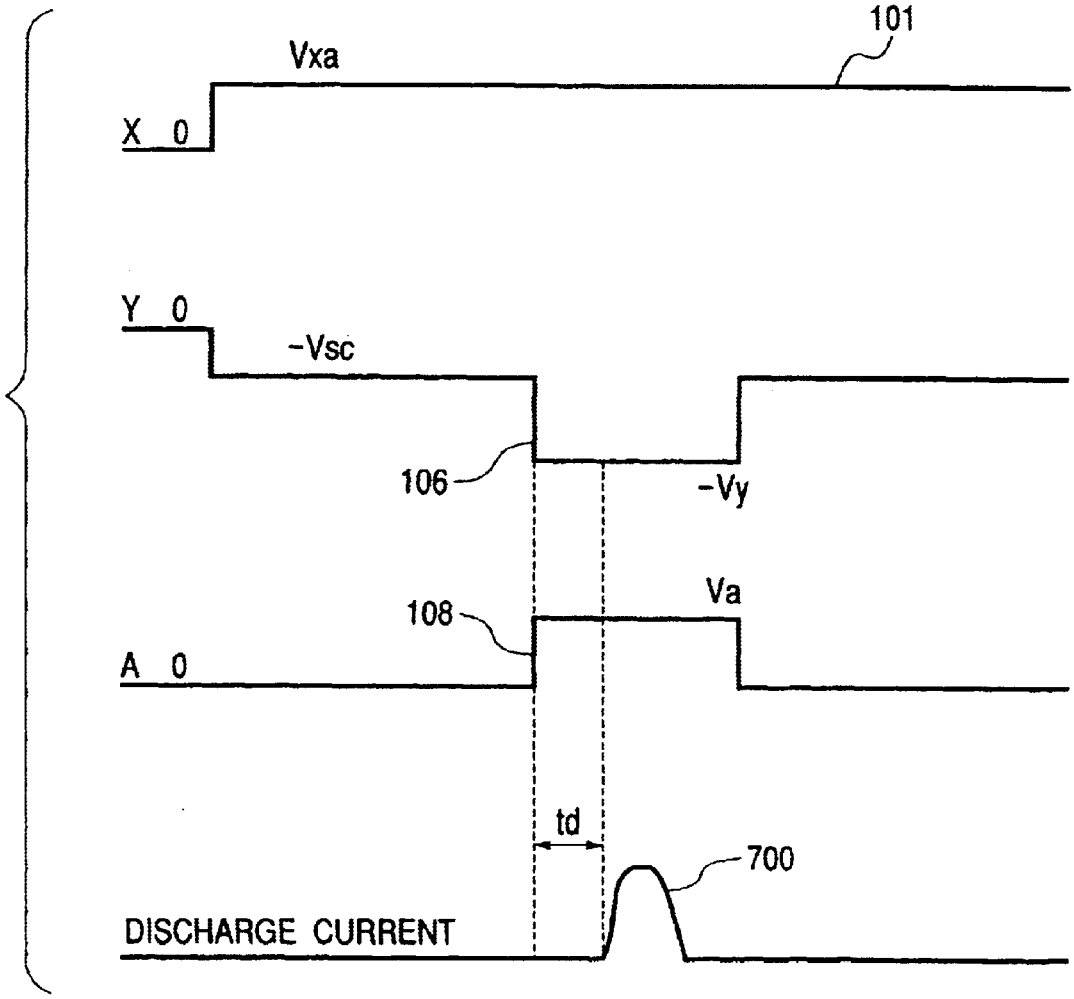
FIG. 7 shows a view explaining a delay of a conventional address discharge becoming a comparative example.

FIG. 7 shows a view illustrating the conventional scanning pulse 106 and a discharge current 700. When the scanning pulse 106 and the address pulse 108 are overlapped with each other, a discharge is generated between the electrodes A–Y with a time delay td from the time has applied the pulse, and a discharge between the electrodes X–Y triggered by the delayed discharge is generated. The discharge between the electrodes A–Y and the discharge between the electrodes X–Y are conducted approximately at the same time, the discharge current 700 at that time is carried and forms a wall charge.

The discharge delay time td, is a duration gradually performing growth (growing process of Townsent) of a space charge in such a manner as that firstly secondary electrons are generated by colliding the several number of the space charges floating in a space with the electrodes, the secondary electrons are accelerated in an electric field and Ne atoms and Xe atoms in a space are ionized, ionized particles again collided with the electrodes, to thereby generate the secondary electron. Further, when the space charges are increased up to a certain degree, a discharge is started at the stroke. Accordingly, the discharge delay time is a period for the growth of the space charge. A duration td is 0.5 μs, this is one of the reason why the address discharge can not be exerted at high speed.

Figure 8:
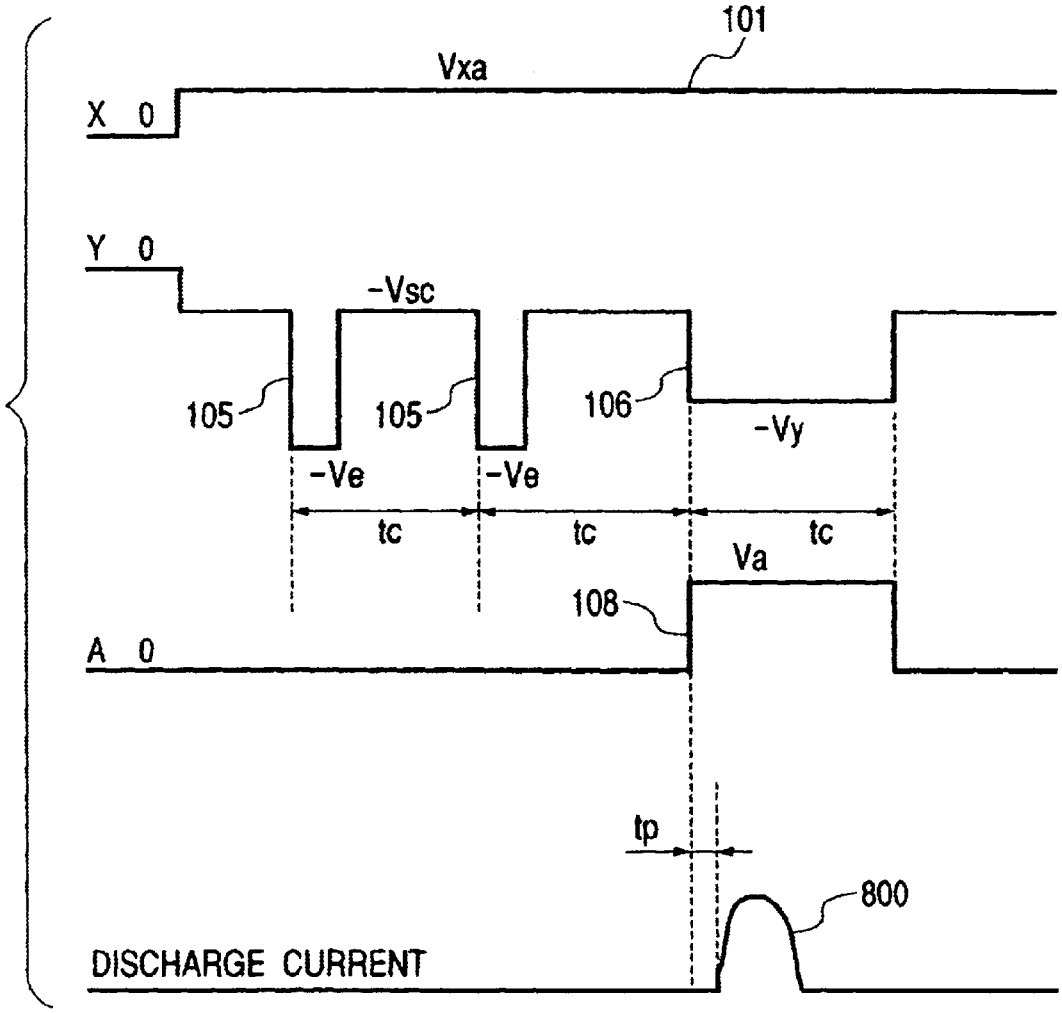
FIG. 8 shows a view explaining acceleration of an address discharge by a preset pulse of the present invention.

FIG. 8 shows a view illustrating a current of an address discharge when the preset pulse of the present invention is applied. As illustrated in FIG. 8, the growth of the space charge is intermittently carried out by the preset pulse 105, the address discharge 800 by the scanning pulse 106 is raised in a shorter duration tp than that of a conventional method. A duration tp in this case is 0.2 μs, the discharge delay is shortened the more remarkably than the conventional discharge duration delay td (approximately 0.5 μs) illustrated in FIG. 7, the address discharge 800 is raised abruptly to that extent.

A cycle tc of the preset pulse 105 is constituted as the same as a cycle tc of the scanning pulse 106, a cycle becomes approximately 2 μs, however, since time of the recombination of an ion with an electron is approximately 10 μs, so that the next preset pulse is applied before the space charge is disappeared, therefore, the growth of the space charge is carried out by this intermittent preset pulse.

When the number of preset pulse 105 is increased, a discharge is generated by the preset pulse 105 of this side of the scanning pulse 106, resulting in the formation of a wall charge, so that the address discharge by the scanning pulse 106 is disturbed, therefore, the number of the preset pulse 105 is preferably to be the highest possible number at which the preset pulse 105 of this side of the scanning pulse 106 are liable to be but not to be discharged.

Second Embodiment

Figure 9:
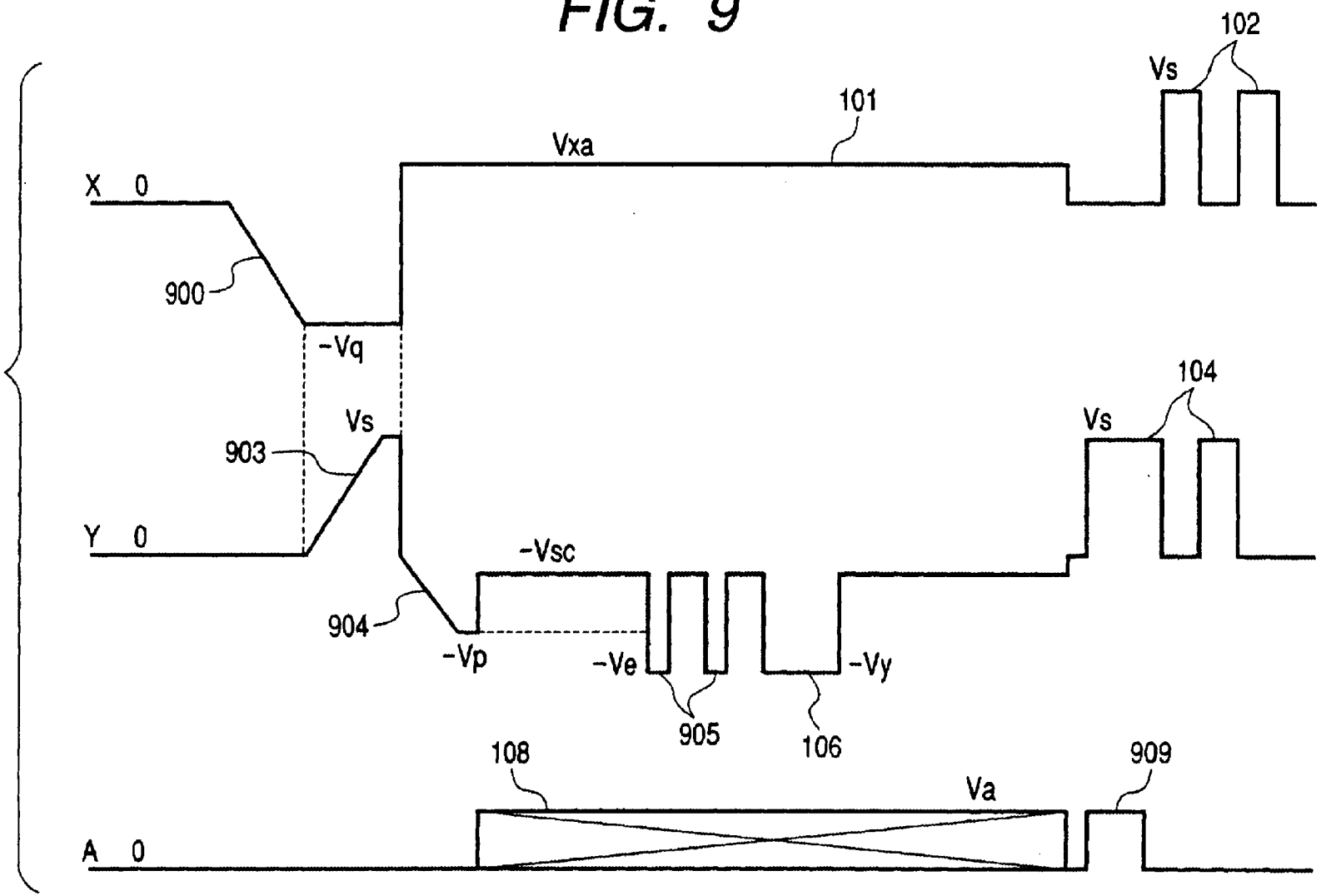
FIG. 9 shows a view illustrating a driving waveform when applied the present invention to a lamp wave reset.

FIG. 9 shows a view illustrating the other driving waveform for displaying an image of an AC-type plasma display apparatus to be the second embodiment of the present invention. Here, the present invention will be explained by taking up a lamp wave reset as an example.

Firstly, a gently falling down waveform 900 (lamp wave) is applied to an X electrode up to a voltage −Vq and a wall charge remained in the prior sub-field is erased. Next, a gently rising voltage waveform 903 (first lamp wave) is applied to a Y electrode up to a voltage Vs when a voltage of the X electrode is −Vq.

Thereby, a fine discharge is generated while a cell voltage (application voltage+wall voltage) retains a discharge breakdown voltage Vt between the electrodes X"Y, and a wall charge is formed only a voltage portion of difference between an application voltage and Vt.

Next, a bias pulse 101 of a voltage Vxa is applied to the X electrode, and a gentle waveform 904 (second lamp wave) of a voltage up to a voltage −Vp is applied to the Y electrode, this time, a wall charge is formed so as to constitute a cell voltage being at a constant amount of −Vt. In a terminated voltage −Vp of the lamp wave 904, since a cell voltage is retained at an amount of −Vt, when a larger (at negative polarity) voltage is applied than the voltage of the cell voltage −Vt, a discharge is started.

Next, in an address period, equal to or more than 1 piece (in FIG. 9, 2 pieces) of a preset pulse 905 of a thin line duration is/are applied to the Y electrode prior to time applying a scanning pulse 106. At this time, when a voltage of the preset pulse 905 and a voltage (−Vy) of the scanning pulse 106 are made equal to each other, and the voltage of −Vy is lager than the terminate voltage (−Vq) of the lamp wave 904, a voltage (−Ve) of the preset pulse 905 constitutes the voltage to start a discharge.

However, since the preset pulse 905 is a narrow width pulse, only a growing process of Townsent before sufficient growth of a discharge is carried out. Accordingly, in the preset pulse 905, a current scarcely carried, no formation of a wall charge can be conducted. The number of charged particles in a space is increased by the preset pulse 905, so that rising of address discharge during a period of a next scanning pulse 106 can be abruptly performed.

A display sustain period after termination of an address period, display sustain pulses (sustain pulses) 102 and 104 of a voltage Vs are alternately applied to the X electrode and the Y electrode, display light emission can be conducted.

Figure 10:
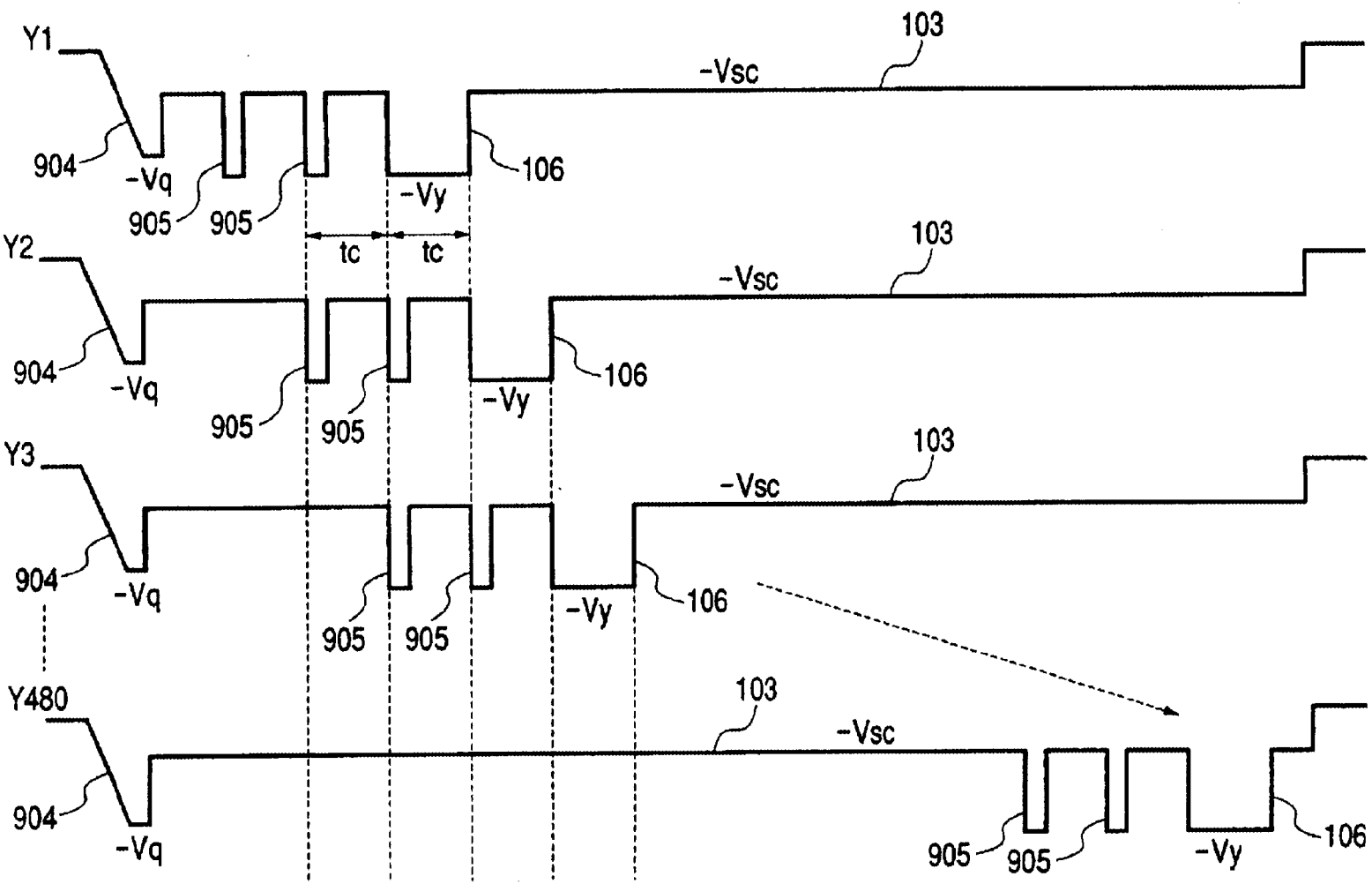
FIG. 10 shows a view explaining a method of scanning a preset pulse of the present invention.

FIG. 10 shows a view illustrating a method of scanning of a preset pulse of the present invention in the lamp wave reset in FIG. 9. Basically, FIG. 10 is the same as the figure in FIG. 6 of the first embodiment, the scanning pulse 106 sequentially scanned from a Y1 electrode to Y480 electrode, and the preset pulse 905 conforming to that, scans respective Y electrodes. At this time, since a cycle tc of the scanning pulse 106 is the same as a cycle tc of the preset pulse, and also voltages of both pulses are −Vy and having the same values, a control of a circuit becomes simple, and simplification of a circuit constitution can be realized.

Figure 11:
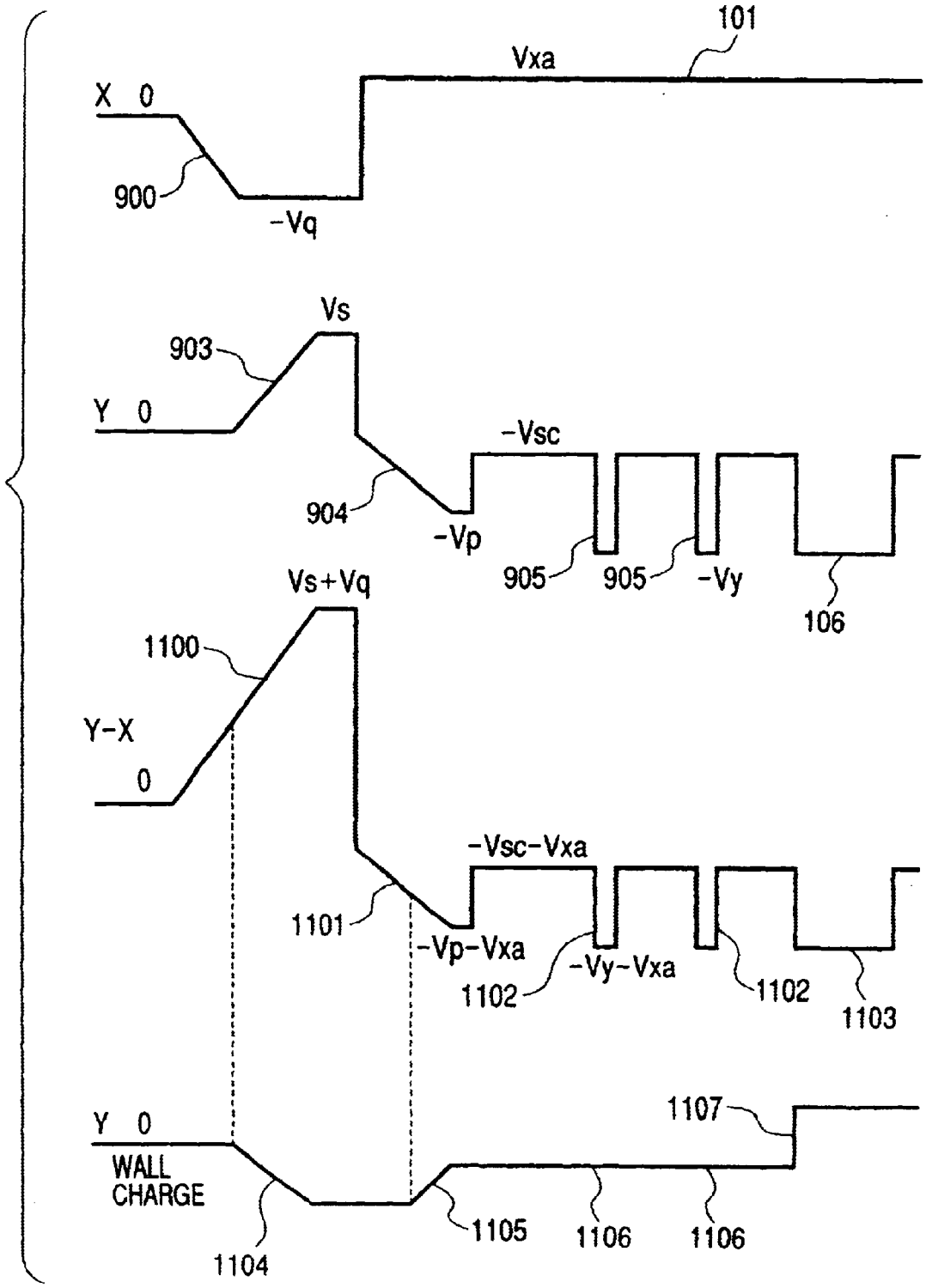
FIG. 11 shows a view explaining a lamp wave reset and a wall charge of the present invention.

FIG. 11 shows a view illustrating a relationship between a discharge breakdown voltage of a lamp wave reset and a preset pulse and a wall charge. A wall charge between the electrodes X–Y are substantially erased to a value of 0 by an erasing pulse 900 of the X electrode. However, there are dispersion to the remained wall charges by the dispersion of the cells or the like. The lamp wave reset has an effect to uniformly reset the entire cells by eliminating the dispersion of these cells.

When voltages between cells exceed a discharge breakdown voltage Vt of a cells between the electrodes X and Y by a first lamp wave 903 of the Y electrode, a fine discharge is generated, and a wall charge 1104 is formed so as the voltages between the cells invariably being at a constant amount of Vt. Even if remained wall charges are different from each other by the dispersion of the cells, when the cell voltage exceed Vt somewhere in the first lamp wave, the fine discharge is generated and the cell voltages of the entire cell become uniform with a value Vt.

A second lamp wave 904 is the lamp wave having reverse polarity to the first lamp wave 903, a discharge is carried out at a cell of a wall charge of the reverse polarity which is a case where the first lamp wave will not be discharged. At this time, the cell voltage is −Vt and is constant. Of course, a cell discharged by the first lamp wave, also discharges by this second lamp wave, the cell voltage formed a wall charge 1105 becomes an amount of −Vt.

Here, the terminated voltage of the second lamp wave 904 is −Vp, the cell voltage is −Vt, the entire cell becomes in a state of very limit of stopping a discharge. Accordingly, when the Y electrode becomes a voltage larger than −Vp, since the cell voltage exceeds a discharge breakdown voltage −Vt, a discharge is started.

Since the voltage of the preset pulse 905 is −Vy, and the voltage larger than −Vp, its voltage exceeds a discharge breakdown voltage, however, since the voltage is narrow width, a discharge current is not carried and a new wall charge is not formed. Here, only growth (growing process of Townsent) of a space charge is performed.

Figure 12:
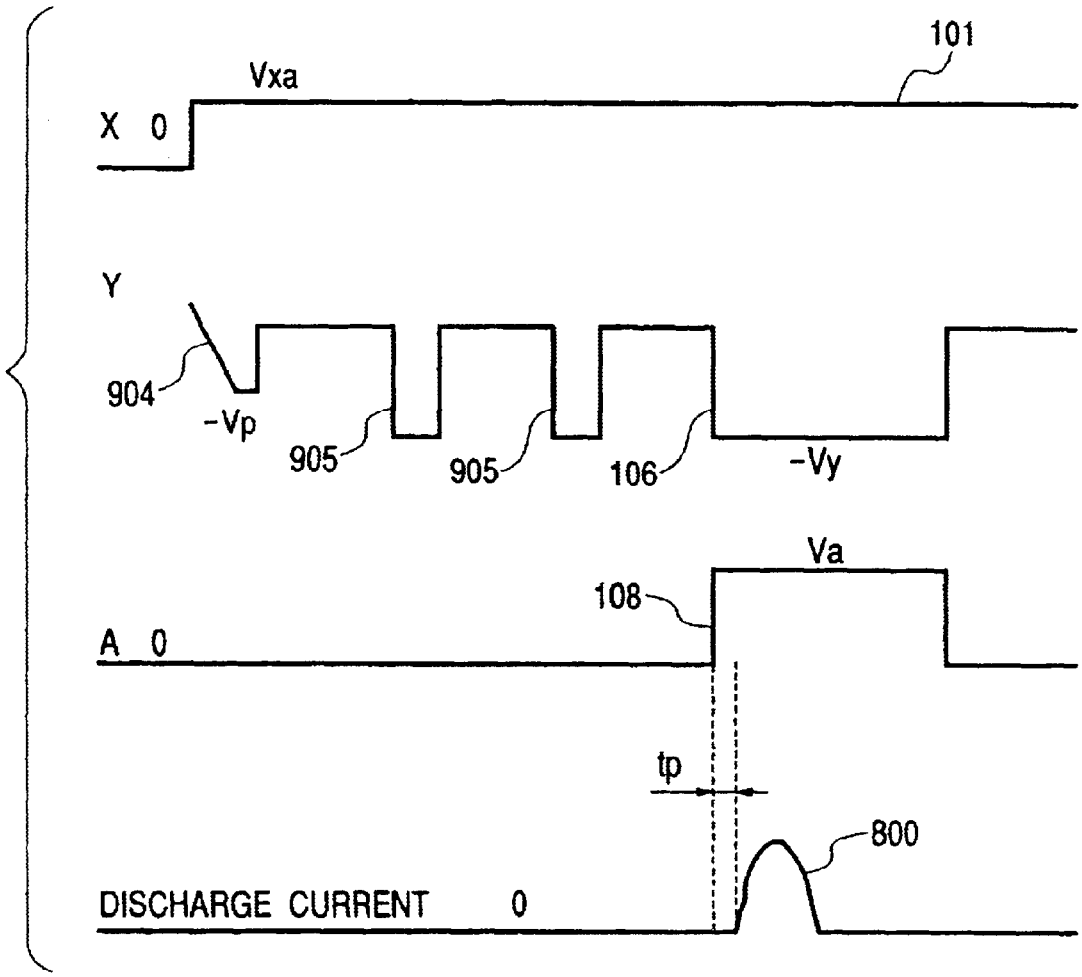
FIG. 12 shows a view explaining a relationship of a lamp wave reset and a preset pulse of the present invention.

FIG. 12 shows a view illustrating a current of an address discharge when a preset pulse 905 of the present invention is applied. The growth of the space charge by the preset pulse 905 is intermittently carried out, and an address discharge by the scanning pulse 106 is raised in short time tp. A voltage of the preset pulse 905 is −Vy, since the voltage is larger than a terminated voltage −Vp of the second lamp wave 904, thus the voltage exceeds a discharge breakdown voltage.

The voltage of the preset pulse 905 is the same as the voltage (−Vy) of the scanning pulse, so that the scanning pulse 106 also exceeds a discharge breakdown voltage. Accordingly, during a period of the preset pulse, the growth of the space charge is conducted, in the scanning pulse, the address discharge can be driven further at a low voltage. A discharge is generated while there is no address pulse to the A electrode in the scanning pulse, since it is fine discharge, the wall charge is not formed to such an extent as to make discharge the sustain pulse of the display period. Accordingly, there is no generation of an erroneous operation to a display.

In this case also, same as illustrated in FIG. 8 of the first embodiment, an address discharge 800 by the scanning pulse 106 is raised in shorter time tp than a case of the conventional discharge.

Figure 13:
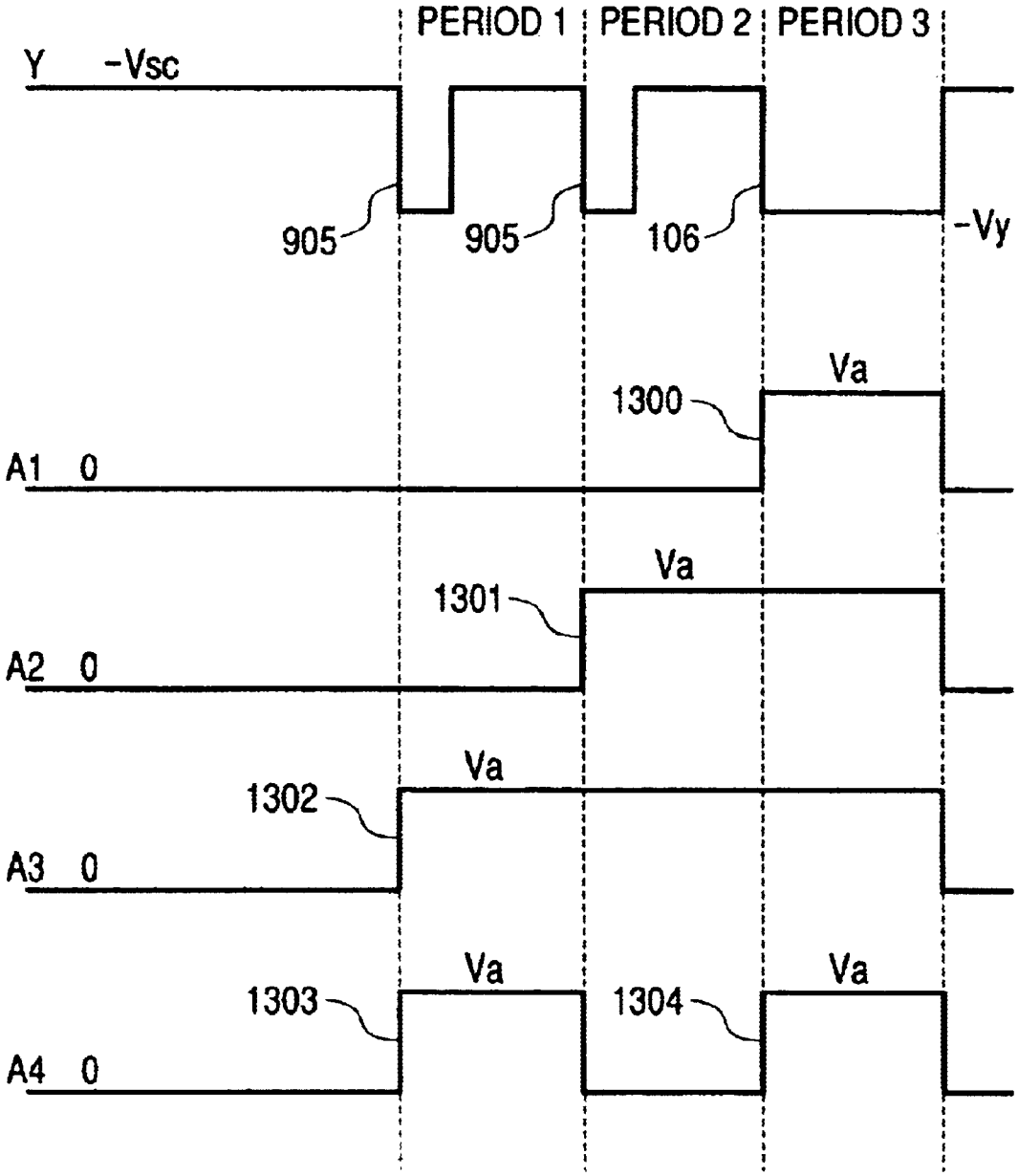
FIG. 13 shows a view explaining a relationship of a preset pulse and an address pulse of the present invention.

FIG. 13 shows a view illustrating a state of the preset pulse 905 and a duration of the address pulse. Even if the address pulses 1301, 1302, and 1303 are existed at portions of periods (period 1 and period 2) of the preset pulse, the durations of the preset pulses 905 are required to be adjusted so as not to generate a discharge.

Basically, since the growth of the space charge by the preset pulse is generated between the electrodes X–Y, so that existence of the address pulse during the periods of the preset pulses do not influence so much on a discharge, however, if a width of a pulse of the preset pulse is selected to a degree of 0.3 $\mu$s, even if there is the address pulse, a discharge is not generated.

Third Embodiment

Figure 14:
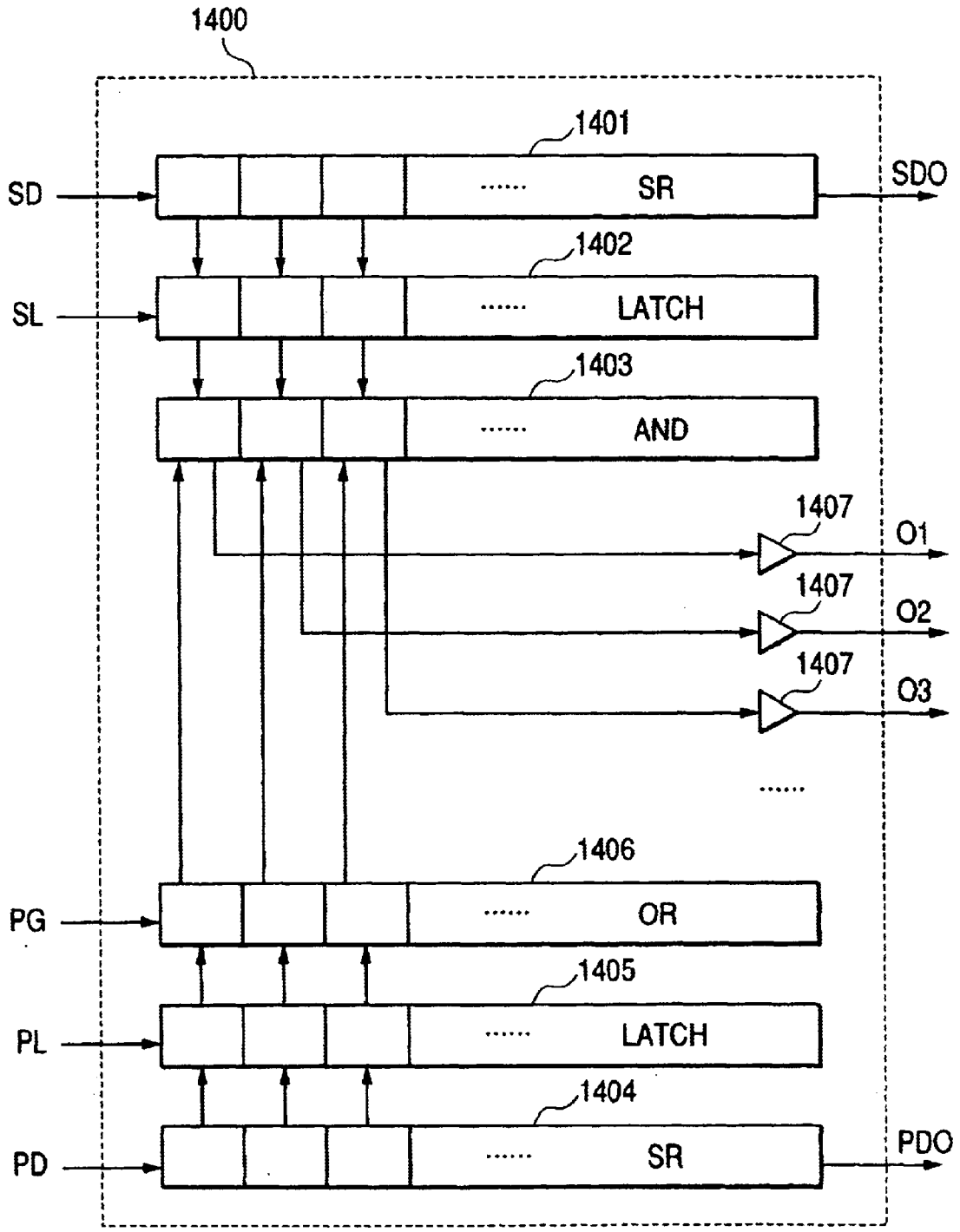
FIG. 14 shows a view illustrating a constitution of an IC circuit outputting a reset pulse and a scanning pulse of the present invention.
Figure 15:
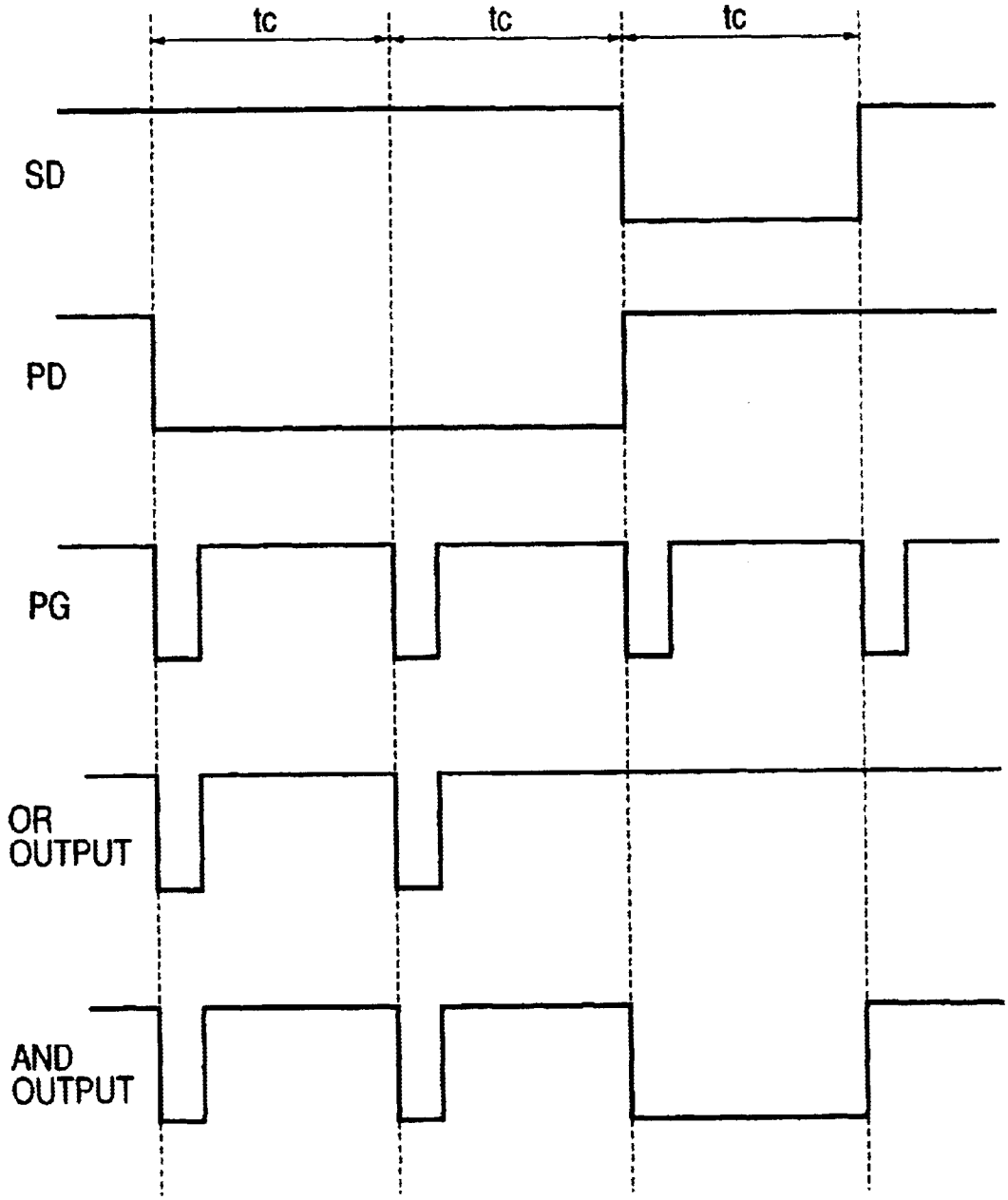
FIG. 15 shows a view illustrating a signal waveform for explaining an IC operation for driving an AC-type plasma display apparatus of the present invention.

FIG. 14 shows a circuit diagram of a scan IC outputting a preset pulse of the present invention and FIG. 15 shows a signal wave diagram explaining an operation of the scan IC. Next, the operation of the scan IC will be explained.

As illustrated in FIG. 14, in a scanning circuit 1400, a date signal SD of a scanning pulse is inputted to a shift register 1401, and transferred at a cycle of the scanning pulse. A signal of the scanning pulse shifted one by one, is converted into a parallel signal by a latch circuit 1402 and inputted to an AND circuit 1403.

As illustrated in FIG. 15, a date signal SD of the scanning pulse is a signal of a negative logic. On the other hand, a signal PD of the preset pulse, as illustrated in FIG. 15, is inputted to a shift register 1404 as a signal of 2 pieces at 2 pieces this side of the scanning pulses. The signal PD of the preset pulse is transferred in the same time as a cycle tc of the scanning pulse.

The signal PD of the preset pulse shifted by the shift register is converted into parallel output signals by a latch circuit 1405, and inputted to an OR circuit 140 determining a pulse duration and a phase of the preset pulse.

The pulse duration and the phase of the preset pulse PD are formed into pulse signals by continuous thin line duration pulses of a PG signal. This narrow width preset pulse signal PG and a signal SD of the scanning pulse are inputted into an AND circuit, the thin line duration preset pulse signal PG is OR processed with the preset pulse signal PD by the OR circuit 1406 and inputted into narrow width preset path 1403, thereby both wave form are overlapped with each other, they are converted into necessary high voltage signal by a high voltage amplifier circuit 1407, to thereby apply to the Y electrodes.

As described above, the embodiment of the preset pulse is explained, the number of the preset pulses is not limited to 2 pieces in this embodiment, if the number is equal to 1 piece or more than that, such cases are included in the present embodiment. Further, the preset pulse is explained by setting it just before the scanning pulse, however, as long as the pulses are within a period of addresses, even if the preset pulse is separated from the scanning pulse, such a case is also included in the present invention.

What is claimed is:

1. An AC-type plasma display apparatus comprising:

(a) display electrodes composed of paired first electrodes and second electrodes in parallel with each other;

(b) address electrodes intersecting the display electrodes; and (c) drive circuits conducting address discharges between the display electrodes and the address electrodes;

wherein the drive circuits conducting the address discharges include means for applying pulses equal to or more than one piece of a narrow width predetermined as preset pulses prior to a time of applying a scanning pulse applied to the display electrode; and wherein an applied voltage of the preset pulses is set as a voltage value exceeding a discharge breakdown voltage value determined by a wall charge of a reset discharge.

2. An AC-type plasma display apparatus according to claim 1, wherein the preset pulses are the pulses of a narrow width of such a degree as not generating a discharge.

3. An AC-type plasma display apparatus according to claim 1, wherein the preset pulses are the pulses of a narrow width of such a degree as not forming a wall charge.

4. An AC-type plasma display apparatus according to claim 1, wherein a pulse width of the preset pulses is a pulse of a narrow width of 0.3–0.5 μs.

5. An AC-type plasma display apparatus according to claim 1, wherein a cycle of the preset pulses is the same as a cycle of the scanning pulses.

6. An AC-type plasma display apparatus comprising:

(a) display electrodes composed of paired first electrodes and second electrodes in parallel with each other;

(b) address electrodes intersecting the display electrodes; and (c) drive circuits conducting address discharges between the display electrodes and the address electrodes;

wherein the drive circuits conducting the address discharges include means for applying pulses equal to or more than one piece of a narrow width predetermined as preset pulses prior to a time of applying a scanning pulse applied to the display electrode;

wherein an applied voltage of the preset pulses is set as a voltage value exceeding a discharge breakdown voltage value determined by a wall charge of a reset discharge;

wherein the AC-type plasma display apparatus provides a plurality of sub-fields within one field, the sub-field includes a reset period for at least making uniform a wall charge, an address period for writing-in, and a display sustain period for display light emission, and has a function for applying scanning pulses sequentially to an electrode corresponding to a display line during the address period;

wherein in the address period, the drive circuits conducting the address discharges include means for applying pulses equal to or more than one piece of a narrow width predetermined as preset pulses prior to a time of applying the scanning pulse; and wherein an applied voltage of the preset pulses is a voltage value larger than a discharge breakdown voltage determined by a wall charge formed after the reset period is terminated, and the preset pulse is sequentially scanned keeping a constant time interval with the scanning pulse.

7. An AC-type plasma display apparatus according to claim 6, wherein the preset pulse is a pulse with a narrow width in such a degree as a discharge being not generated.

8. An AC-type plasma display apparatus according to claim 6, wherein the preset pulse is a pulse with a narrow width in such a degree as a wall charge being not formed.

9. An AC-type plasma display apparatus according to claim 6, wherein the preset pulse is a pulse having a narrow width, and a width thereof being 0.3–0.5 μs.

10. An AC-type plasma display apparatus according to claim 6, wherein the preset pulse has a cycle the same as a cycle of the scanning pulse.

11. An AC-type plasma display apparatus comprising:

(a) display electrodes composed of paired first electrodes and second electrodes in parallel with each other;

(b) address electrodes intersecting the display electrodes; and (c) drive circuits conducting address discharges between the display electrodes and the address electrodes;

wherein the drive circuits conducting the address discharges include means for applying pulses equal to or more than one piece of a narrow width predetermined as preset pulses prior to a time of applying a scanning pulse applied to the display electrode;

wherein an applied voltage of the preset pulses is set as a voltage value exceeding a discharge breakdown voltage value determined by a wall charge of a reset discharge;

wherein the AC-type plasma display apparatus includes a paired plurality of first display electrodes and second display electrodes in parallel with each other and a plurality of address electrodes intersecting the display electrodes, at least the display electrode includes a panel covered by dielectric layer, a time of one field is divided into a plurality of sub-fields, the sub-field includes at least a reset period, an address period, and a display sustain period;

wherein in case of conducting write-in by applying a scanning pulse to the first display electrodes during the address period and by applying an address pulse to the address electrode, the sub-field described above includes means for applying pulses equal to or more than one piece of a narrow width having the same polarity as the scanning pulse predetermined as preset pulses prior to a time of applying the scanning pulse applied to the first display electrode; and wherein an applied voltage of the preset pulses is set as a voltage value exceeding an address discharge breakdown voltage.

12. An AC-type plasma display apparatus according to claim 11, wherein the preset pulse is a pulse with a narrow width in such a degree as a discharge being not generated.

13. An AC-type plasma display apparatus according to claim 11, wherein the preset pulse is a pulse with a narrow width in such a degree as a wall charge being not formed.

14. An AC-type plasma display apparatus according to claim 11, wherein the preset pulse is a pulse having a narrow width, and a width thereof being 0.3–0.5 μs.

15. An AC-type plasma display apparatus according to claim 11, wherein the preset pulse has a cycle the same as a cycle of the scanning pulse.

16. An AC-type plasma display apparatus comprising:

(a) display electrodes composed of paired first electrodes and second electrodes in parallel with each other;

(b) address electrodes intersecting the display electrodes; and (c) drive circuits conducting address discharges between the display electrodes and the address electrodes;

wherein the drive circuits conducting the address discharges include means for applying pulses equal to or more than one piece of a narrow width predetermined as preset pulses prior to a time of applying a scanning pulse applied to the display electrode;

wherein an applied voltage of the preset pulses is set as a voltage value exceeding a discharge breakdown voltage value determined by a wall charge of a reset discharge;

wherein the AC-type plasma display apparatus divides one field into a plurality of sub-fields and the sub-field includes at least a reset period, an address period, and a display sustain period;

wherein during the reset period, in case of conducting write-in operation by applying an entire reset pulse accompanied by a self erasing discharge to the second display electrodes, by resetting a remained wall charge of a plasma display panel, and by applying a scanning pulse to the first display electrodes during the address period and by applying a scanning pulse to the first display electrode, the sub-field described above includes means for applying preset pulses equal to or more than one piece predetermined prior to applying the scanning pulse applied to the display electrode; and wherein an applied voltage of the preset pulses is set as a voltage value larger than that of the scanning pulse, and a voltage value exceeding a discharge breakdown voltage.

17. An AC-type plasma display apparatus according to claim 16, wherein the preset pulse is a pulse with a narrow width in such a degree as a discharge being not generated.

18. An AC-type plasma display apparatus according to claim 16, wherein the preset pulse is a pulse with a narrow width in such a degree as a wall charge being not formed.

19. An AC-type plasma display apparatus according to claim 16, wherein the preset pulse is a pulse having narrow, and width thereof being 0.3–0.5 $\mu$s.

20. An AC-type plasma display apparatus according to claim 16, wherein the preset pulse has a cycle the same as a cycle of the scanning pulse.

21. An AC-type plasma display apparatus comprising:

(a) display electrodes composed of paired first electrodes and second electrodes in parallel with each other;

(b) address electrodes intersecting the display electrodes; and (c) drive circuits conducting address discharges between the display electrodes and the address electrodes;

wherein the drive circuits conducting the address discharges include means for applying pulses equal to or more than one piece of a narrow width predetermined as preset pulses prior to a time of applying a scanning pulse applied to the display electrode;

wherein an applied voltage of the preset pulses is set as a voltage value exceeding a discharge breakdown voltage value determined by a wall charge of a reset discharge;

wherein the AC-type plasma display apparatus divides one field into a plurality of sub-fields and the sub-field includes at least a reset period, an address period, and a display sustain period; and wherein, during the reset period, the sub-field described above includes means for conducting a lamp wave reset discharge, for resetting, and for lessening a terminated voltage value of the lamp wave to be smaller than a voltage value of a scanning pulse applied during the address period, and means for applying pulses equal to or more than one pieces of a narrow width of a voltage value approximately similar to the scanning pulse predetermined as a preset pulse prior to a time of applying the scanning pulse, in case of application of a scanning pulse to the first display electrodes during the address period.

22. An AC-type plasma display apparatus according to claim 21, wherein the preset pulse is a pulse with a narrow width in such a degree as a discharge being not generated.

23. An AC-type plasma display apparatus according to claim 21, wherein the preset pulse is a pulse with a narrow width in such a degree as a wall charge being not formed.

24. An AC-type plasma display apparatus according to claim 21, wherein the preset pulse is a pulse having a narrow width, and a width thereof being 0.3–0.5 $\mu$s.

25. An AC-type plasma display apparatus according to claim 21, wherein the preset pulse has a cycle the same as a cycle of the scanning pulse.

* * * * *